US005449280A

United States Patent [19]

Maki et al.

[11] Patent Number: 5,449,280

[45] Date of Patent: Sep. 12, 1995

[54] PUMP INCLUDING INTEGRAL RESERVOIRS FOR PERMITTING DRY RUN OF PUMP

[75] Inventors: Bruce A. Maki, Warren; David L. Thompson, Clinton Township, both of Mich.

[73] Assignee: Hypro Corporation, St. Paul, Minn.

[21] Appl. No.: 224,247

[22] Filed: Apr. 7, 1994

[51] Int. Cl.[6] ..... F04C 5/00; F04C 15/00

[52] U.S. Cl. ..... 418/133; 418/154; 418/180; 418/181; 415/141

[58] Field of Search ..... 418/75, 77–79, 418/102, 132, 133, 154, 180, 181; 415/56.3, 141

[56] References Cited

U.S. PATENT DOCUMENTS

| | | | |
|---|---|---|---|
| 2,336,580 | 12/1943 | Yeatman | 418/154 |
| 2,455,194 | 11/1948 | Rumsey | 418/154 |
| 2,636,443 | 4/1953 | Rand | 418/154 |
| 2,664,050 | 12/1953 | Abresch | 418/154 |
| 2,832,293 | 4/1958 | Adams et al. | 418/79 |
| 2,855,857 | 10/1958 | Chien-Bor Sung | 418/77 |
| 2,882,830 | 4/1959 | McDuffie | 418/154 |
| 2,903,991 | 9/1959 | Carlson et al. | 418/154 |
| 3,041,979 | 7/1962 | McLean et al. | 418/133 |
| 3,161,135 | 12/1964 | Erikkson | 418/154 |
| 3,386,386 | 6/1968 | Erikkson | 418/154 |
| 4,392,779 | 7/1983 | Bloemers et al. | 418/154 |

FOREIGN PATENT DOCUMENTS

| | | | |
|---|---|---|---|
| 2942570 | 4/1980 | Japan | 418/133 |
| 61-175290 | 8/1986 | Japan | 418/154 |

*Primary Examiner*—John J. Vrablik

*Attorney, Agent, or Firm*—Haugen and Nikolai

[57] ABSTRACT

A pump having a housing with an integral fluid reservoir and flexible end plates to permit the pump to be run dry for an extended period of time. A pair of reservoirs are provided, one each side of a pumping chamber. These reservoirs are in fluid communication with the pumping chamber via openings provided through the end plates of the pumping chamber and slots in the impeller hub. When the pump is run dry, fluid stored in these reservoirs is permitted to be released into the pumping chamber to provide a lubrication between the impeller and the chamber walls, thus reducing friction. The chamber end plates are thin and flexible. These end plates can bow outwardly due to the impeller expanding from increased heat when the pump is run dry, and thus reduce friction with the impeller. Accordingly, the pump can be run dry for an extended period of time without damaging or destroying the pump impeller. The end plate openings are preferably provided adjacent the impeller hub such that fluid is released closely proximate the impeller hub. An flexible impeller is preferred, but the present invention is suited for sliding vane and roller type impellers as well.

6 Claims, 3 Drawing Sheets

PUMP INCLUDING INTEGRAL RESERVOIRS FOR PERMITTING DRY RUN OF PUMP

BACKGROUND OF THE INVENTION

CROSS REFERENCE TO A RELATED APPLICATION

Cross reference is made to a related patent application entitled Method of Manufacturing a Pump With a Modular Cam Profile Liner, filed on Feb. 28, 1994, given U.S. Ser. No. 08/202,360 and assigned to the assignee of the present application.

I. Field of the Invention

This invention relates generally to rotary fluid transfer devices, and in particular, to pumps having flexible impellers which can be run dry for an extended period of time.

II. Discussion of the Prior Art

Flexible (elastomeric) impeller pumps function due to an impeller or rotor rotating within a housing chamber and within close tolerances of the chamber walls. A sophisticated cam profile is usually provided within the housing chamber to effect a pumping action. The impeller passes over this cam profile, fluid is caused to be displaced from a suction port to a discharge port, each port being in fluid communication with the pumping chamber. Flexible impeller pumps have been in existence since the 1940's, and have primarily been used for marine engine cooling applications, although there are pumps of this variety used for the industrial transfer of fluids. When in operation, the pumped fluid cools the impeller, and provides for a lubricating film between the impeller and the housing chamber walls. Occasionally, these pumps are required to run dry for limited periods of time. This can be due to long suction lift, operator error, or due to accident such as the intake of the pump becoming clogged.

Under dry run conditions, the friction between the flexible (elastomeric) impeller and the housing rapidly increases. This friction generates heat which causes the impeller temperature to rise until the elastomeric impeller is damaged, or even self destructs. At this time, the impeller loses its ability to pump, and can totally fail. The heat is generated in two primary locations. First, between the impeller distal ends and the cam profile as they are swept across the profile, and secondly, between the impeller hub and the end or side walls of the pumping chamber.

U.S. Pat. No. 2,336,580 to Yeatman discloses an artery-type rotary pump. A sleeve-type rotor is journaled for rotation within a housing. The rotor has a pair of end plates forming an integral portion of the rotor, and thus, rotate therewith. A pair of chambers are provided, one each side of the rotating rotor end plates. These chambers provide lubrication via grooves between the arcuate perimeter of the rotor and the housing inner wall. The pumping action is produced by the expansion and contraction of the cavities formed between the inner and outer rotor sleeve. The rotor is not disposed between and frictionally engaging any fixed end plates, which plates define a pumping chamber.

U.S. Pat. No. 3,386,386 teaches a pump having an external container for storing and feeding liquid to a pumping chamber. Fluid is communicated to the pumping chamber through a wall defining the pumping chamber. Similarly, U.S. Pat. No. 2,636,443 to Rand teaches an external reservoir also communicating a fluid to a pumping chamber to reduce friction and wear if the pump is run dry.

U.S. Pat. No. 3,161,135 to Eriksson teaches a pump having a water pressure switch. This switch senses water pressure, and insures the pump is run only when there is adequate water pressure at the nozzle such that it is not run dry. U.S. Pat. No. 2,455,194 to Rumsey teaches a rotary flexible vane pump with a hub having recessed areas to permit the liquid pump to wet the casing and hub surfaces while rotating.

U.S. Pat. No. 2,664,050 teaches a pump for a washing machine having chambers for trapping liquid within the mechanism to provide automatic lubrication thereof. These chambers are defined in series with the inlet and outlet ports. In an alternative embodiment, the whole pump itself is encased within a second housing filled with fluid. The fluid trapped within this casing helps conduct any heat which is generated by the rotor, and dissipates the heat into the fluid to prevent any high temperature of the rotor.

OBJECTS

It is accordingly a principle object of the present invention to provide a means by which the length of time that a conventional flexible-impeller pump can be run dry is substantially extended.

Still yet a further object of the present invention is to provide a self-lubricating pump which reduces friction between the rotating rotor and the chamber walls when no fluid is being pumped therethrough.

Still yet a further object of the present invention to provide a pump housing which has a reduced friction as the temperature of an impeller increases due to the pump running dry.

The foregoing objects are achieved by the present invention which will now be discussed in considerably detail in the following discussion, and in view of the appended drawings.

SUMMARY OF THE INVENTION

The foregoing objects and advantages are achieved by providing a housing having one or more integral fluid reservoirs which are fluidly coupled to the pumping chamber. These reservoirs store a quantity of pumped fluid during normal operation, and permit release of the stored fluid into the pumping chamber when the pump is run dry. A sufficient quantity of fluid can be stored, and then released into the pumping chamber at a rate such that the pump can be run dry for an extended period of time. Further, fixed end plates defining the pumping chamber are flexible, and reduce the friction generated between these end plates and the impeller hub as the impeller heats up and expands.

Specifically, the present invention includes a housing having a pair of longitudinally spaced end walls, and an intermediate circumferential wall together forming a pumping chamber. The housing has an inlet port and an outlet port, each port being in fluid communication with the pumping chamber. A rotor is rotatably mounted within the pumping chamber for pumping fluid from the inlet port to the outlet port. At least one reservoir integral to the housing is provided which is fluidly coupled to the pumping chamber. This reservoir stores a quantity of fluid, and permits release of this stored fluid into the pumping chamber when the pump is run dry, that is, when no fluid is pumped from the inlet port to the outlet port. This released fluid provides sufficient lubrication to the rotor to reduce friction between the rotor and the chamber walls, specifically, between the impeller vanes and the circumferential wall, and between the impeller hub and the fixed end plates. Fluid is released through end plate openings at a rate which permits the pump to be run dry for an extended period of time without damage. Small amounts of released fluid removes large quantities of heat through the heat of vaporization.

Preferably, one reservoir is formed lateral of and on each side of the rotor, adjacent the fixed housing end walls. One or more openings are defined through the housing end walls such that pumped fluid is forced into the reservoirs and stored during normal pump operation. When fluid ceases to be pumped through the pump chamber, the fluid is released back through these end wall openings into the pumping chamber at a slow and controlled rate. A sufficient amount of fluid is stored and released, thus permitting the pump to be run for an extended period of time.

The end plate openings are preferably concentric with the impeller hub, and have a diameter less than the outer diameter of the impeller hub. The impeller hub has at least one radially extending channel defined in each end, preferably extending the thickness of the impeller hub, to allow fluid to be controllably exchanged between the reservoirs and the pumping chamber.

A second feature of the present invention resides in that the end walls are formed of flexible, thin, wear plates. The reservoir openings are provided through these wear plates, and are provided closely proximate to the impeller hub and axis of rotation. During dry run of the pump, the heat generated from friction causes the impeller grow in length. This, in turn, increases the amount of pressure the impeller exerts on the impeller hub, which in turn further increases the heat generation between the impeller hub and the housing side walls. These wear plates are sufficiently thin such that they can flex outward slightly as the rotor heats up. Accordingly, the heat caused by friction does not increase at an uncontrollable rate. Alone or in combination with the integral reservoirs releasing fluid into the running dry pump, the flexible wear plates permit the pump to be run dry for an extended period of time.

These flexible end walls, and the reservoirs, can be implemented in pumps independently of one another. In the preferred embodiment, both are incorporated into a single pump and compliment one another. While a flexible impeller or rotor is preferred, limitation to a flexible impeller is not to be inferred since other types of rotors could be implemented including sliding vane and roller-type rotors.

Other objects, features and advantages of the present invention will become apparent to those skilled in the art through reading the Description of the Preferred Embodiment, Claims, and drawings herein wherein like numerals refer to like elements.

DESCRIPTION OF THE PREFERRED EMBODIMENT

Figure 1:
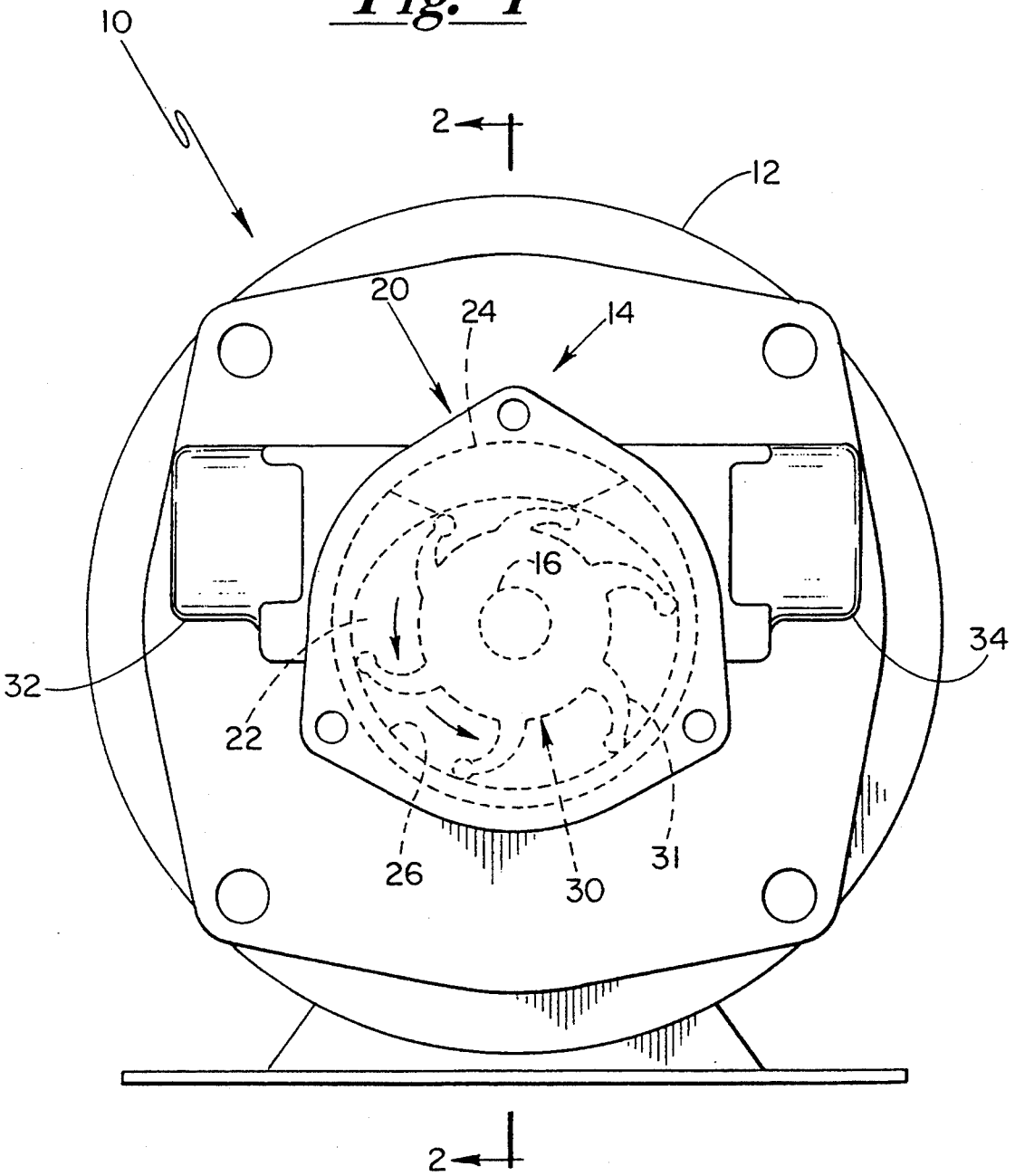
FIG. 1 is an end elevational view of a pump assembly having a flexible impeller rotatably mounted within a cam profile, shown in phantom.

Referring now to FIG. 1, an end elevational view of a pump assembly according to the preferred embodiment of the present invention is generally shown at 10. For purposes of illustration, pump assembly 10 will be discussed as being of the flexible-impeller type, however, limitation to the pump having a flexible impeller is not to be inferred for a sliding vane or roller type impeller could be implemented as well. Pump assembly 10 is seen to include a motor 12 which can be powered by a AC or DC power source (not shown). A pumping unit generally shown at 14 is cantileverly mounted over a drive shaft 16, which shaft is driven by and forms a portion of motor 12. Pumping unit 14 comprises a rigid housing 20 defining a pumping chamber 22 therewithin, shown in phantom. A sophisticated cam profile 24, shown in phantom, is inserted and mounted within chamber 22, and forms a liner for the interior walls of the chamber. Cam profiles are well known in the art for creating suction and discharge forces as the rotor is swept therepast. These cam profiles are typically comprised of either a metal, machined annular member, or a molded plastic member molded as a single unit. Additional discussion of cam profile 24 can be found in a discussion of the cross-referenced pending application.

Cam profile 24 can be seen to include an inner surface 26 having a lower surface of large constant radius smoothly transitioning to an upper surface having a smaller constant radius. Accordingly, the chamber defined within cam profile 24 is symmetrical in shape, as shown. Motor drive shaft 16 axially extends into housing 20 and pumping chamber 22. A flexible-vane impeller 30 having radially extending vanes 31 is axially mounted upon shaft 16 and within pumping chamber 22. Shaft 16 rotatably drives impeller 30, sweeping the impeller vanes across cam profile 24 so as to create a pumping action. Housing 20 includes an inlet or suction port 32, and an outlet or discharge port 34, each port being fluidly coupled to pumping chamber 22. Rotation of impeller 30 within and against cam profile 24 creates a suction at 32, and a discharge of fluid at outlet 34. The pump discussed so far is well known in the art.

Figure 2:
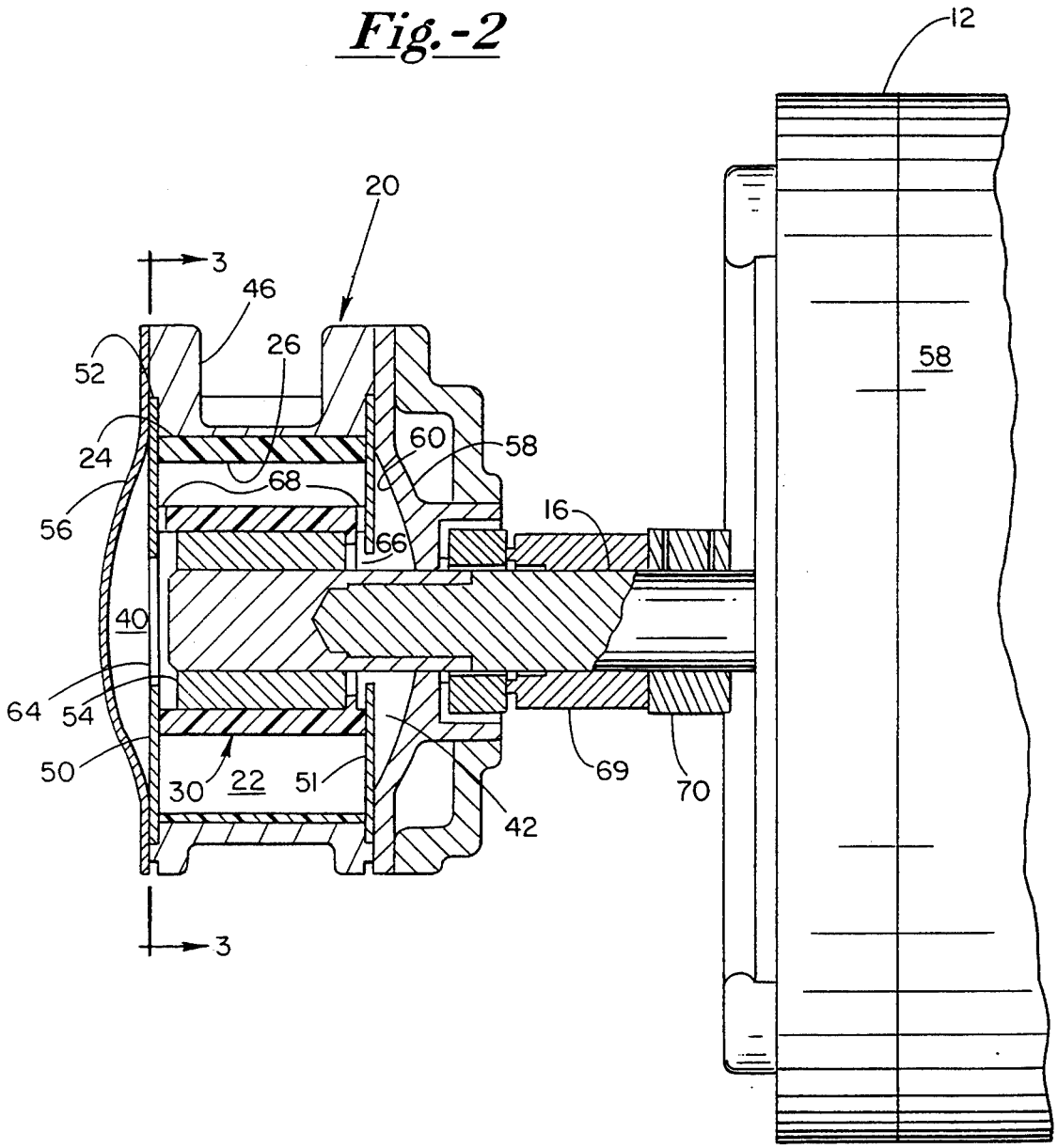
FIG. 2 is a sectional view taken along line 2—2 in FIG. 1 illustrating one integral reservoir formed each side of the impeller and pumping chamber, one formed by the end cover, and the other by the seal retainer, in combination with the pair of thin wear plates, each reservoir being in fluid communication with the cam profile chamber via plate openings and impeller hub channels.
Figure 3:
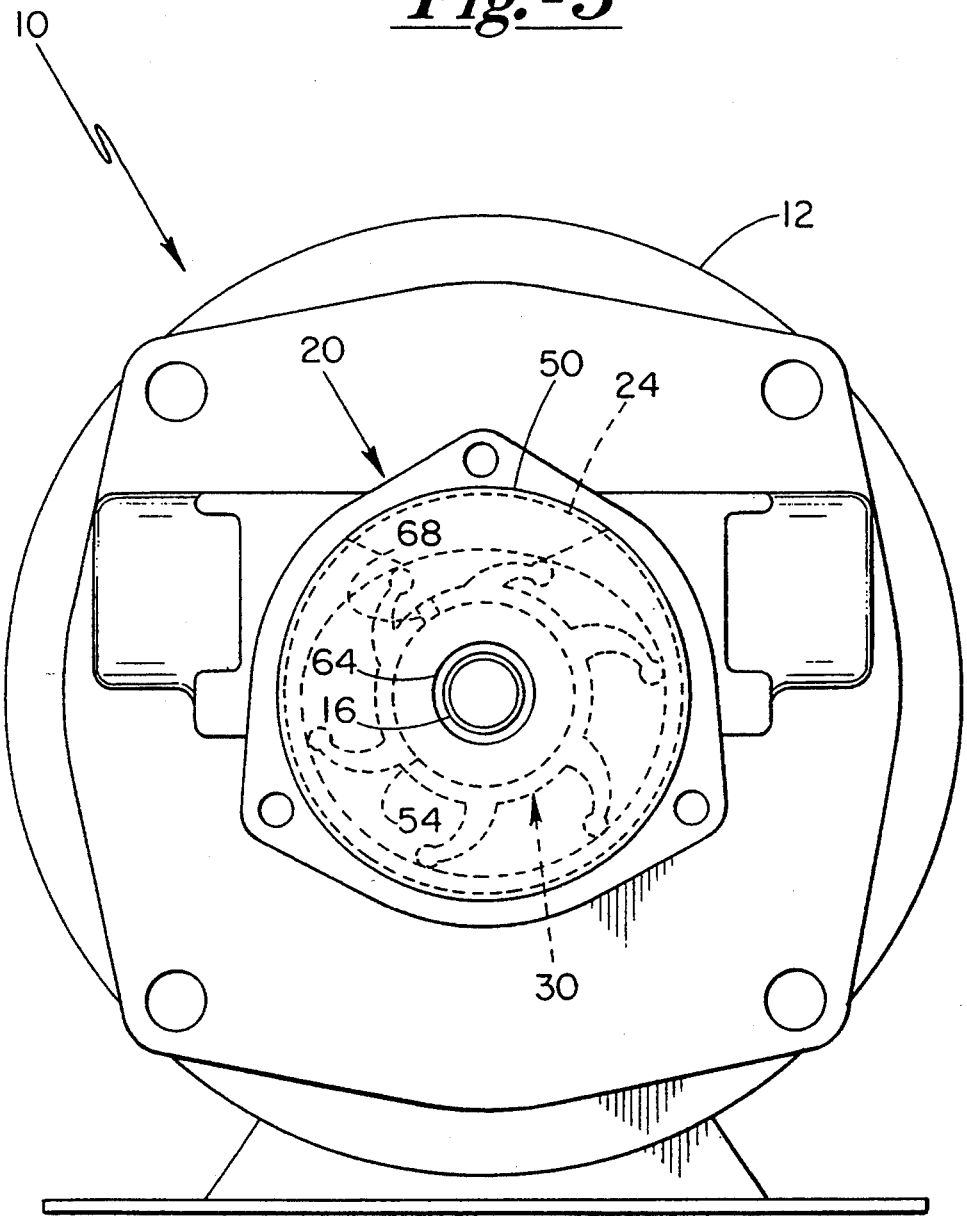
FIG. 3 is a sectional end view taken along line 3—3 in FIG. 2 illustrating the concentric opening formed through one flexible wear plate, this opening providing a fluid path from the reservoir to the cam profile chamber via the hub slots or channels shown in phantom, the plate openings being defined closely proximate the impeller hub.

Turning now to FIG. 2, a sectional view taken along line 2—2 in FIG. 1 is shown to illustrate some of the principle features of the present invention. It can be seen that pump unit 14 includes a pair of integral fluid reservoirs, one defined laterally and each side of impeller 30 and pumping chamber 22, referenced at 40 and 42. Reservoirs 40 and 42 serve to hold or store fluid during normal operation of pump assembly 10, and also serve to dispense and release stored fluid back into pumping chamber 22 when the pump is run dry. This feature serves to provide a lubrication between rotating impeller 30 and the chamber inner walls when the pump is run dry.

Pump housing 20 is comprised of a rigid, annular, housing member 46 forming a circumferential wall.

Cam profile 24 is mounted to the inner arcuate surface of housing 46, but could be formed integral to housing member 46. Cam profile 24 has an intermediate circumferential wall 26 which forms pumping chamber 22, as discussed in regards to FIG. 1. A pair of thin, flexible, identical wear plates 50 and 51 having a circular profile are provided, one being sealingly secured to each side of housing 46. Each plate is securingly seated within a respective conforming recess 52, one recess being defined in each side of housing 46. These thin wear plates form longitudinally spaced end walls of pumping chamber 22. Impeller 30 is mounted upon a keyed, brass, tubular insert 54, this insert being canteleverly mounted on shaft 16 and within pumping chamber 22 for rotation therewithin to effect a pumping action, as previously discussed. Insert 54 is slightly recessed within impeller 30, as shown, to facilitate fluid communication paths as will now be discussed.

A dome-shaped end cover 56 is secured about its perimeter to the outside end of housing 46 and over a perimeter of plate 50. Cover 56 in combination with adjacent end plate 50 defines first reservoir 40 therebetween. A convex seal retainer plate 58 is secured about its perimeter to the opposing side of housing 46 and over a periphery of adjacent end plate 51. Seal retainer plate 58 has a concave shaped inner surface 60 which, in combination with the other end plate 50, defines second reservoir 42 therebetween. Both reservoirs 40 and 42 are defined to have a substantially identical profile, as shown, and an identical volume for storing fluid.

Each end plate 50 and 51 is seen to have defined therethrough a concentric opening 64 and 66, respectively. These openings are defined closely proximate, and concentric with, shaft 16, insert 54, and the hub of impeller 30. The hub of impeller 30 is seen to include a pair of narrow radially extending slots 68, one at each end of the impeller hub. These slots provide a communication path from pumping chamber 22 to each of respective reservoirs 40 and 42. The diameter of opening 64 and 66 is larger than the diameter of shaft 16, but less than the outer diameter of the hub of impeller 30. The flush, annular, sealing ends of impeller hub 30 are sealed against respective end plates 50 and 51 to insure an effective pumping action, yet slots or channels 68 provide fluid communication between the respective reservoirs and pumping chamber 22. While the diameter of openings 64 and 66 is shown being less than both the inner diameter of impeller hub 30 and the outer diameter of insert 54, limitation to this diameter is not to be inferred. Rather, it is only preferred that the diameter of openings 64 and 66 be less than the outer diameter of the hub of impeller 30 so that a proper sealing effect against the end plates is obtained.

By way of illustration, a typical pump would have a $\frac{5}{8}''$ diameter shaft, a $\frac{7}{8}''$ diameter opening 64 and 66 defined through end plates 50 and 51, the insert 54 having an outer diameter of 1.06 inches, and the seal hub of impeller 30 having a 17/16" outer diameter and 119/64" inner diameter. One (or more) slot or channel 68 is formed into each end of the impeller seal hub having a preferably dimension of 0.08 inches wide by 0.02 inches deep, and having a length equal to the thickness of the impeller hub, as shown. This fluid communication arrangement permits the controlled exchange of fluid between the reservoirs to the pumping chamber 22, either when filling or discharging. While one notch or slot 68 is shown defined in each side of impeller hub 30, it is to be recognized that multiple slots could be provided, or slots having dimensions other than that described to establish a desired fluid communication path between reservoirs 40 and 42 and the pumping chamber 22.

In still yet another embodiment, one or more openings could be provided through end plates 50 and 51 to directly communicate the fluid reservoirs to pumping chamber 22, and thus limitation to the openings 64 and 66 being defined concentric with shaft 16 is not to be inferred. Rather, the present invention is intended to include all embodiments having a communication path from integral fluid reservoirs to the pumping chamber to provide a slow controlled release of fluid into the pumping chamber when the pump is run dry. Hence, a perforated end plate may be suitable in some applications as well. In the present preferred embodiment, the opening 64 and 66 is chosen to have a diameter greater than the diameter of shaft 16 such that shaft 16 can extend through both of these openings, although shaft 16 is shown to be extended only through the opening of the proximal end plate 51.

In operation, a small quantity of the fluid being pumped by pump unit 14 will be caused to flow through plate openings 64 and 66, and radially extending impeller slots 68 into reservoirs 40 and 42 due to the fluid pressure. The fluid will be stored in reservoirs 40 and 42 during normal operation. However, should the pump begin to run dry, fluid stored in each of reservoirs 40 and 42 will be slowly discharged and released via openings 64 and 66, and slots or channels 68 into pumping chamber 22. This discharged fluid will serve as a lubricant between rotating impeller 30 and the surfaces in friction contact with the pumping chamber walls. Specifically, the fluid will serve as lubricant between the hub of impeller 30 and the end plates 50 and 51, and also between the distal ends of the impeller vanes 31 swept across the cam profile inner surface 26.

One principle feature of the present invention is that due to the small cross-section of slots 68 in impeller hub 30, fluid will be slowly and controllably discharged from these reservoirs into the pumping cavity 22, and proximate the sealing impeller hub, providing lubrication. The slow leakage rate allows the pump to be run dry for an extended period of time by preventing the excess generation of heat created from friction. Without these fluid reservoirs providing lubrication, the friction generated between the rotating impeller and the pumping chamber walls would generate excessive heat, thus causing the impeller to expand and increase friction to the point that the impeller would self-destruct. With the implementation of the integral reservoirs, sufficient lubrication is provided to allow the pump to run dry for an extended period of time, without damage to the pump. A seal sleeve 69 is provided about shaft 16, between reservoir 42 and motor 12, for sealing fluid from bearings 70.

A second principle feature of the present invention resides in the thin and flexible wear plates 50 and 51. Each of wear plates 50 and 51 is identical and comprised of a thin, circular piece of aluminum. Accordingly, a good liquid seal is maintained between impeller 30 and each side plate 50 and 51 for proper operation of the pump. However, should the impeller 30 begin to heat-up and expand from friction, which happens when the pump is run dry, each end plate 50 and 51 is sufficiently flexible so that it can bow slightly outward into the respective reservoir 40 and 42. This outward flexing of the end plates 50 and 51 serves to eliminate the amount of friction which would otherwise be generated with rigid sidewalls. A slight compression is still maintained between the impeller and the side walls, which is necessary to achieve a good liquid seal for good pump performance and suction lift. Accordingly, as the impeller of a dry running pump starts to heat-up, the amount of compression on the impeller, and especially the impeller hub, does not increase nearly so dramatically as is experienced with pumps having rigid housing walls, or thick walled end plates.

Standing alone or in combination, the two principle features of the present invention allow the pump to run dry for an extended period of time. The coefficient friction between the flexible impeller and the wear plates is dramatically reduced by the presence of small amounts of water released from the reservoirs, and due to the flexure of the flexible end plates. Small amounts of water released from the reservoirs can remove large quantities of heat through the heat of vaporization. The rate at which water contained in the reservoirs is allowed to leak or dispense into the pumping chamber is determined by the size, shape, and position of the openings through the end plates with respect to the impeller hub. Due to these features, the life of a flexible impeller run dry is considerably extended.

Again, the reservoirs become filled with fluid during normal operation of the pump. This will occur rapidly, particularly when the pump is under pressure. When the pump is used for cooling a boat engine, the reservoirs may also achieve their fill when the boat is checked out, such as when it is run at least once under a watchful individual, mechanic, or boat owner before being used regularly. Water in the reservoir does not pose a problem to freezing since the reservoirs will slowly half empty once a boat is out of the water. Further, anti-freeze is generally run through the raw water cooling of an engine as part of the winter storage procedures. Thus, any ice which may form in the reservoirs has room to expand, and by virtue of the flexible wear plates.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself. For instance, while a pair of integral reservoirs have been shown to be formed lateral and each side of the impeller, it is to be recognized that integral reservoirs or small pockets could be formed in the circumferential wall of the cam profile to contain fluid. These reservoirs would also slowly release fluid back into the pump chamber when the pump is run dry. In still yet another embodiment, small pores forming reservoirs could be formed in the impeller hub, and would operate in much the same way. Thus, it is envisioned that any reservoirs integral to the pump housing which are placed in fluid communication with the pumping chamber, and which can dispense the fluid when a pump is run dry, are covered by the present application.

We claim:

1. A pump assembly for pumping a fluid, comprising:

(a) a housing having a pair of longitudinally spaced end walls and an intermediate circumferential wall forming a pumping chamber, said housing having an inlet port and an outlet port in fluid communication with said pumping chamber;

(b) rotor means rotatably mounted within said pumping chamber and including an impeller hub supporting a plurality of elastomeric impellers for pumping said fluid from said inlet port to said outlet port, said impellers disposed closely proximate said housing end walls and said impeller hub including a radial port of a predetermined size; and (c) reservoir means formed integral to said housing and fluidly coupled to said pumping chamber for storing a quantity of said fluid, and for permitting release of said stored fluid into said pumping chamber at a controlled rate through said radial port when no said fluid is being pumped from said inlet port to said outlet port to provide lubrication between said impellers and said pumping chamber.

2. The pump assembly as specified in claim 1 wherein said reservoir means comprises a reservoir fluidly coupled to said pumping chamber through at least one said housing end wall.

3. The pump assembly as specified in claim 2 wherein said reservoir means comprises a reservoir fluidly coupled to said pumping chamber through both said housing end walls.

4. The pump assembly as specified in claim 1 wherein said housing end walls are comprised of deformable plates.

5. The pump assembly as specified in claim 4 wherein said plates are sufficiently thin so as to bow outwardly from said pumping chamber when exerted upon by a predetermined fluid pressure within said pumping chamber.

6. The pump assembly as specified in claim 1 further comprising a motor drivingly coupled to said rotor means for rotating said rotor means within said pumping chamber.

* * * * *